United States Patent [19]

Kitamura et al.

[11] Patent Number: 4,486,088

[45] Date of Patent: Dec. 4, 1984

[54] METHOD AND APPARATUS FOR ELECTROPHOTOGRAPHY CAPABLE OF CHANGING OVER IMAGES FROM POSITIVE TO NEGATIVE AND VICE VERSA

[75] Inventors: Takashi Kitamura, Yokohama; Michio Ito, Hachioji, both of Japan

[73] Assignee: Canon Kabushiki Kaisha, Tokyo, Japan

[21] Appl. No.: 383,098

[22] Filed: May 28, 1982

Related U.S. Application Data

[63] Continuation of Ser. No. 104,704, Dec. 17, 1979, abandoned.

[30] Foreign Application Priority Data

| | | | |
|---|---|---|---|
| Dec. 26, 1978 | [JP] | Japan | 53-161400 |
| Dec. 26, 1978 | [JP] | Japan | 53-161402 |
| Dec. 26, 1978 | [JP] | Japan | 53-161404 |
| Dec. 26, 1978 | [JP] | Japan | 53-161406 |

[51] Int. Cl.[3] ..... G03G 13/02

[52] U.S. Cl. ..... 355/3 CH; 430/55; 430/67; 430/100

[58] Field of Search ..... 430/55, 67, 100; 355/3 CH

[56] References Cited

U.S. PATENT DOCUMENTS

| | | | |
|---|---|---|---|
| 4,197,119 | 4/1980 | Sadamatsu et al. | 430/55 |
| 4,230,783 | 10/1980 | Aoki et al. | 430/55 |
| 4,262,075 | 4/1981 | Noda et al. | 430/55 |
| 4,310,610 | 1/1982 | Sakai | 430/55 |
| 4,311,778 | 1/1982 | Kadowaki et al. | 430/55 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

A novel method and apparatus for electrophotography is disclosed which enables selection the mode of image formation among positive-positive, negative-positive and combinations thereof without any need of changing the polarity of developing toner. The present invention is made on the basis of a known electrophotographic system in which a photosensitive member composed of essentially an electrically conductive substrate, a photoconductive substance layer and an insulating surface layer and which comprises the steps of charging the insulating surface layer, image-wise exposing it to light so as to form a first image almost simultaneously with or some time after the charging step, subjecting it to corona discharge with nearly simultaneous image-wise exposure so as to form a second image and uniformly exposing the whole surface of the photosensitive medium to light so as to form an electrostatic latent image corresponding to a composite image resulting from the first and second images. According to the invention the first and second images to be formed are identical with each other and either one of the two images is selectively exposed to obtain the desired image.

6 Claims, 42 Drawing Figures

METHOD AND APPARATUS FOR ELECTROPHOTOGRAPHY CAPABLE OF CHANGING OVER IMAGES FROM POSITIVE TO NEGATIVE AND VICE VERSA

This is a continuation of application Ser. No. 104,704, filed Dec. 17, 1979 now abandoned.

BACKGROUND OF THE INVENTION

1. Field of the Invention

The present invention relates to electrophotography. More particularly, the present invention is directed to a novel method and apparatus for electrophotography which enables one to selectively produce a positive-positive image at one time, negative-positive image at another time or both at the same time.

2. Description of the Prior Art

As electrophotography there are known and used various systems such as Electrofax, Xerox, P.I.P. (Persistent Internal Polarization) and NP system. For example, reference is made to U.S. Pat. Nos. 3,666,363 and 4,071,361 and German Pat. Nos. 1,522,567 and 1,522,568.

According to Electrofax and Xerox systems, an electrostatic image is formed in accordance with the principle of the well-known Carlson process as described in U.S. Pat. No. 2,297,691. The photosensitive medium used in these systems comprises a layer of photoconductive substance such as zinc oxide (Electrofax), amorphous selenium (Xerox) and the like formed on a substrate. The surface of the photoconductive layer is electrically charged by corona discharge and then it is exposed to an original image. At the area exposed to the light, the electric charge is decayed so that an electrostatic image corresponding to the light and dark pattern of the original is produced. The electrostatic image is visualized by developing it with charged and colored particles. The visualized image is fixed directly after development or after transferring it onto a supporting member such a sheet of paper. Thus, an electrophotographic image can be obtained.

P.I.P system is featured by the fact that a latent image is formed making use of particular physical properties of fluorescent material, that is, persistent internal polarization and photoconductivity. The NP system uses such photosensitive medium comprising further an insulating layer overlaid the above mentioned photoconductive substance layer. An electrostatic image is formed making use of the difference in electrostatic capacity between the two layers as well as the photoconductivity thereof. An electrophotographic image is obtained from such latent image through the steps of developing, transferring and fixing which are essentially the same as above.

Many types of copying apparatus have been developed based upon the above described various electrophotography techniques. Generally speaking the copying machine is used to produce images in a mode of positive-positive, namely to obtain a positive copy from a positive original. However, sometimes it is wished to obtain a positive copy from a negative original using the same copying machine for positive-positive. This applies, for example, to apparatus for enlarging and printing microfilms.

To attain the dual purposes of positive-positive and negative-positive with one and same apparatus it was hitherto required to change the polarity of electric charge applied to the photosensitive medium or to change the polarity of developing toner for two different cases. This makes the apparatus complicated, enlarged and very expensive. Moreover, images thus produced are unstable.

As a solution to the above problem, U.S. Pat. No. 3,990,791 has disclosed an image forming apparatus for forming positive and negative images employing the known electrophotographic technique.

SUMMARY OF THE INVENTION

Accordingly, it is a general object of the invention to provide a novel method and apparatus which eliminates the above disadvantages involved in the prior art system.

More particularly, it is an object of the invention to provide an electrophotographic method and apparatus which is useful for both of positive-positive and negative-positive image formations and in which any one of the two image forming modes can be selected by a simple selective change-over operation.

It is another object of the invention to provide such method and apparatus which enables the dual image formation for positive-positive and negative-positive with a single machine.

According to one aspect of the invention to attain the above objects it is possible to provide a multifunctional apparatus by combining an electrophotographic copying machine with a recently proposed laser beam printer or adding an overlay function to an electrophotographic copying machine or combining an electrophotographic copying machine with a microfilm enlarging and printing apparatus.

It is a further object of the invention to provide a method for electrophotography employing an electrophotographic system of the type in which a photosensitive medium composed of essentially an electrically conductive substrate, a photoconductive layer and an insulating layer, and which comprises the steps of applying electric charge to the surface of said insulating layer while subjecting said photosensitive medium to a first image forming irradiation nearly simultaneously with or some time after said charging, effecting corona discharge (AC or DC) on said surface while subjecting said photosensitive medium to a second image forming irradiation nearly simultaneously with said corona discharge and then exposing the whole surface of said photosensitive medium uniformly to light so as to form an electrostatic latent image of a composite image resultant from said first and second images, which method is characterized in that said first and second images to be formed are identical to each other and said image forming irradiation is changed over selectively for either one of said two images and that when said first image forming irradiation is selected, said photosensitive medium is subjected to said first image forming irradiation while applying electric charge to said insulating layer surface nearly simultaneously with or some time before said irradiation. The insulating layer surface is subjected to corona discharge in the dark and the whole surface of said photosensitive medium is exposed uniformly to light so as to form an electrostatic latent image, and when the second image forming irradiation is selected, said photosensitive medium is subjected at first to a whole surface exposure while applying electric charge to the insulating layer surface nearly simultaneously with or some time before the whole surface exposure, then said photosensitive medium is subjected to the second image forming irradiation while applying to said insulating layer surface corona discharge nearly simultaneously and the whole surface of said photosensitive medium is exposed uniformly to light so as to form an electrostatic latent image.

The electrostatic latent image thus formed is visualized with a developing agent composed mainly of charged and colored particles, and the visualized image is transferred onto a transfer member such as a paper sheet making use of an internal or external electric field and is then fixed by suitable fixing means such as infrared lamp or heating plate to obtain a final electrophotographic image. On the other hand, after transferring, the photosensitive medium is subjected to a cleaning treatment to remove the remaining charged particles from the insulating layer surface and to make it prepared for reuse in the next cycle of process.

Preferred embodiments of the present invention directed to apparatus include:

An electrophotographic apparatus comprising a photosensitive medium composed basically of an electrically conductive substrate, a photoconductive layer and an insulating layer; electric charge applying means for applying electric charges to said photosensitive medium and enabling said photosensitive medium to be exposed to an image forming irradiation nearly simultaneously with said charging; corona discharge means for enabling said photosensitive medium to be exposed to another irradiation to form the same image; means for whole surface exposure; and change-over means for changing over said image forming irradiation from one to another to carry out said image forming irradiation nearly simultaneously with the operation of either one of said electric charge applying means and corona discharge means so as to selectively change the latent image to be formed from positive to negative and vice versa;

An electrophotographic apparatus comprising a photosensitive medium composed of basically an electrically conductive substrate, a photoconductive layer and an insulating layer; electric charge applying means for applying electric charges to said photosensitive medium; corona discharge means; image forming irradiation means; whole surface exposure means; and change-over means for selectively changing over said image forming irradiation from one between said electric charge application and corona discharge to another simultaneous with said corona discharge and vice versa so as to selectively change the latent image to be formed from positive to negative and vice versa;

An electrophotographic apparatus comprising a photosensitive medium composed of basically an electrically conductive substrate, a photoconductive layer and an insulating layer; electric charge applying means for applying electric charges to said photosensitive medium and enabling said photosensitive medium to be exposed to an image forming irradiation nearly simultaneously with said charging; charging means for charging said photosensitive medium with the polarity opposite to that of the above said electric charge and enabling said photosensitive medium to be exposed to another irradiation to form the same image; whole surface exposure means; and change-over means for changing over said image forming irradiation from one to another to carry out said image forming irradiation nearly simultaneously with the operation of either one of said electric charge applying means and opposite polarity charging means so as to selectively change the latent image to be formed from positive to negative and vice versa;

An electrophotographic apparatus comprising a photosensitive medium composed of basically an electrically conductive substrate, a photoconductive layer and an insulating layer; electric charge applying means for applying electric charges to said photosensitive medium; means for providing an image forming irradiation; charging means for applying to said photosensitive means electric charges with the polarity opposite to that of the above electric charge, and enabling said photosensitive medium to be exposed to another irradiation to form the same image; whole surface exposure means and change-over means for changing over said image forming irradiation from one to be done after the operation of said electric charge applying means to another to be done simultaneously with the operation of said opposite polarity charging means and vice versa so as to selectively change the latent image to be formed from positive to negative and vice versa.

Other and further objects, features and advantages of the invention will appear more fully from the following description in connection with the accompanying drawings.

DESCRIPTION OF THE PREFERRED EMBODIMENTS

EMBODIMENT 1

Figure 1:
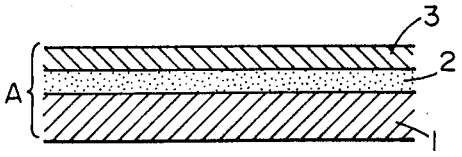
FIG. 1 shows a typical arrangement of a photosensitive medium used in the invention.

The arrangement of a photosensitive medium useful for forming thereon electrostatic images is described referring to FIG. 1. Designated by 1 is an electrically conductive substrate or support, 2 is a photoconductive substance layer and 3 is an insulating surface layer. The photoconductive layer 2 is formed by coating a photoconductive substance on the substrate 1 using a sprayer, coater or wheeler. if necessary, the second layer 2 may include a small amount of binder such as resin to improve the adhesion of the layer to the adjoining layers. The insulating layer 3 is uniformly and closely adhered to the photoconductive layer 2. These three layers 1, 2 and 3 are essential for forming a photosensitive medium A used in the invention. The photosensitive medium A may comprise further one or more optional layers, such as a control layer for limiting the migration of electric charge may be disposed between the electrically conductive substrate 1 and photoconductive layer 2. Also, a layer for capturing electric charges may be provided on the surface of photoconductive layer 2 or in the vicinity of the surface alone or together with the above control layer. The photoconductive layer preferably has a possible highest resistance in the dark.

As the conductive substrate 1 there may be used tin, copper, aluminium or like metal conductor or moisture absorbing paper. A laminated substrate composed of a paper and an aluminium foil laminated on the paper is a preferable example of the conductive substrate 1 since it is inexpensive and easy to place on the circumference of a drum.

Examples of material for forming the photoconductive layer 2 include CdS, CdSe, crystalline Se, ZnO, ZnS, Se, $TiO_2$, SeTe, PbO or mixtures thereof. In the art there is known such a photoconductive layer having a charge injection property. In this case, electric charges of particular polarity are injected into the photoconductive layer from the electrically conductive substrate when charged in the dark. If this charge injection property has any undesirable effect on the charge distribution made by the first imagewise exposure accompanied with nearly simultaneous primary charging in the embodiment hereinafter described, the primary charging in the embodiment must be carried out with such polarity which can not induce such charge injection in the dark. When the photoconductive layer 2 is made of such photoconductive substance which has substantially no charge injection property or no adverse effect on the charge distribution, the charging step can be carried out with either of the polarities.

The insulating layer 3 may be formed by any available material with the provision that the material should have high abrasion resistance, an electrostatic charge retaining property with high resistance and it should be transparent. Examples of suitable material include fluorine resin, polycarbonate resin, polyethylene resin, cellulose acetate resin and polyester resin. Among them, fluorine resin is preferable since it can be very easily cleaned. As described later, the photosensitive medium is used many times after cleaning it by elastic materials provided after the developing and transferring stations. Therefore, fluorine resin is preferably used in the embodiments of the invention.

Figure 2:
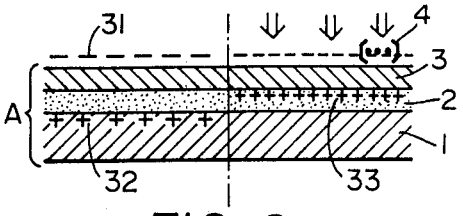
FIGS. 2 to 4 illustrate the manner of forming a composite latent image on the photosensitive medium at different phases of the image formation.
Figure 3:
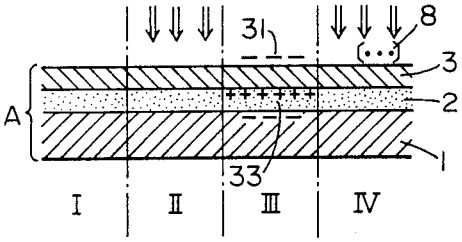
Figure 4:
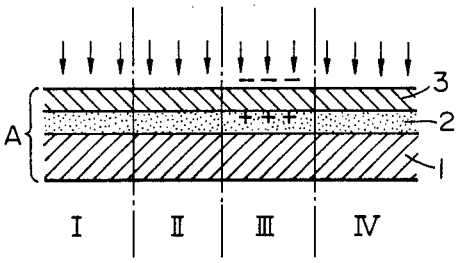

FIGS. 2 to 4 illustrate how a composite latent image is formed on the above described photosensitive medium A by electric charges.

At the step shown in FIG. 2, the photosensitive medium A is subjected to corona discharge by a corona discharger 4 to charge the surface of its insulating top layer 3 with, for example, negative (−) charges. At nearly the same time, a first image-wise exposure is carried out. At the dark area the photoconductive layer 2 is high in resistance and therefore positive (+) charges 32 are induced in the interface between the layers 1 and 2 or in the part of the layer 2 close to the substrate layer 1. On the other hand, at the light area the photoconductive layer 2 is made conductive by the stimulus of light and therefore positive (+) charges are injected into the layer 2 from the substrate 1. The injected positive charges are attracted by negative charges on the surface and finally the positive charges stay in the interface between the layers 2 and 3 (see FIG. 2). In this process the surface potential of the insulating layer 3 is gradually increased in the negative direction with charging time, which is shown by a characteristic curve Vp in FIG. 5.

At the next step, the surface of the insulating layer 3 is subjected to a second image-wise exposure accompanied with nearly simultaneous AC discharging by AC corona discharger 8 (FIG. 3).

Since corona discharge by the above corona dischargers 4 and 8 takes place nearly simultaneously with the respective image-wise exposure, each corona discharger is preferably so made as to have a transparent upper portion or optically opened upper portion with no shield plate.

In FIGS. 3 and 4, the areas indicated by I and II are those areas which were dark in the first image. Since the negative charges 31 on the insulating layer 3 in these areas I and II are free from retaining force, all or a large portion of the charges are discharged.

Area IV is such area which was light in both of the first and second image. Positive charges 33 staying in the interface between the layers 2 and 3 in the area IV get in a state to be easily discharged into the conductive substrate 1 and the retaining force acting on the negative charges 31 becomes lost. Therefore, also in the area IV, all or a large portion of the negative charges 31 are discharged together with the positive charges 33.

The amount of electric charges to be discharged in this manner varies depending upon the duration time and intensity of AC corona discharge.

The area indicated by III is an area which was light in the first image but was dark in the second image. In the area III the photoconductive layer 2 has a high resistance value and no release of the positive charge 33 staying in the interface into the substrate 1 occurs. Therefore, the negative charges 31 on the surface of insulating layer 3 remain under the retaining force by the positive charges 33 and a very smaller amount of negative charges 31 can be discharged by the above AC corona discharger in the area III as compared with other areas I, II and IV.

Thus, a large amount of negative charge remains on the surface of the insulating layer 3 in the area III. However, at the same time, in this area there remains also a large amount of positive charge 33 in the photoconductive layer 2. Therefore, the field formed by the remaining surface charges on the insulating layer 3 acts, to its great extent, in the direction toward the positive charges 33 staying in the photoconductive layer 2 so that the external field resulting from the surface charge may be made extremely weak (see FIG. 3).

At the step shown in FIG. 4, the whole surface of the photosensitive medium A is illuminated by light from the side of its insulating layer 3. This whole surface exposure may be carried out from the side of the substrate 1 so long as the latter is light transmissive. At the areas I, II and IV there occurs no substantial change of charge distribution in the photoconductive layer 2 at this time. Therefore, the surface potential on the insulating layer 3 remains unchanged and is in the same level as that in FIG. 3, that is, 0 volt.

However, at the area III which was light in the first image and dark in the second image, a change occurs in the layer 2. Since in this area the photoconductive layer 2 was not exposed to light at the time of the second image-wise exposure, its resistance was high in the area. Now, the resistance is reduced abruptly by the whole surface exposure and therefore the photoconductive layer 2 becomes conductive also in the area III. The positive charges 33 previously captured and staying in the layer 2 dissipate through the conductive substrate 1 excepting only such amount of remaining positive charge 33 equivalent to the charged load 31 on the surface of the insulating layer 3. As a result of it, the external field at the surface charge 31 increases rapidly and the surface potential rises up accordingly. This change of the surface potential at the area III is shown by characteristic curve $V_{LD}$ in FIG. 5.

Figure 5:
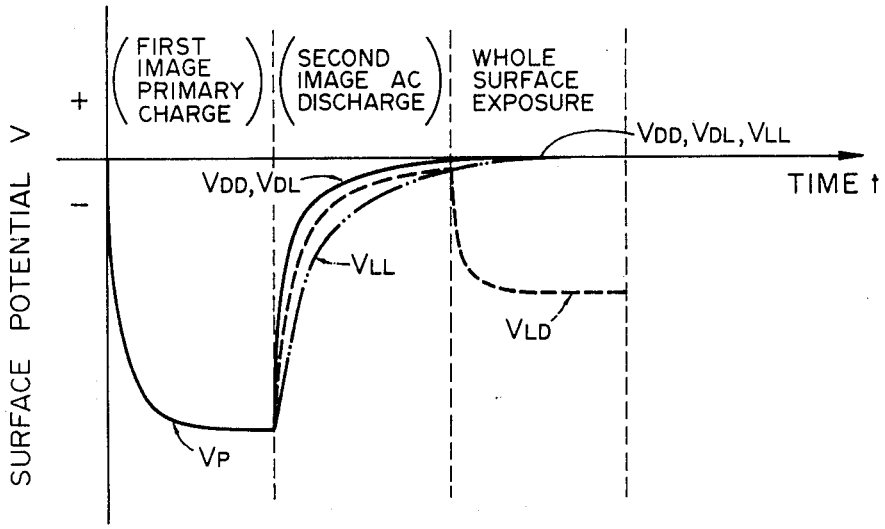
FIG. 5 is a graph showing the change of surface potential on the photosensitive medium at the different steps shown in FIGS. 2 to 4.

In FIG. 5, curve $V_{DD}$ is for area I, $V_{DL}$ for area II and $V_{LL}$ for area IV. From these characteristic curves it is clearly seen that after the whole surface exposure the surface potential has a high negative value $V_{LD}$ only at area III. At other areas I, II and IV the surface potentials $V_{DD}$, $V_{DL}$ and $V_{LL}$ are all at the level of about 0 (zero). Thus, an electrostatic latent image is formed on the photosensitive medium A as a composite image resultant from the first and second images. This composite image can be visualized by developing the photosensitive medium A with toner.

Figure 6:
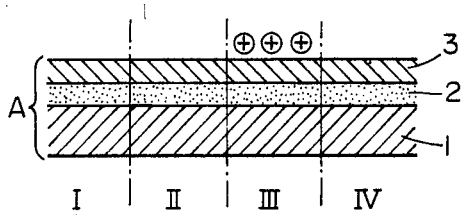
FIGS. 6 and 7 illustrate the process of development of the latent image at two different phases.

FIG. 6 illustrates development of the above latent image by positive toner the polarity of which is opposite to that of the above described primary charge. The toner adheres to the area III.

Figure 7:
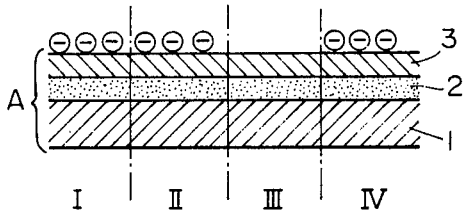
Figure 8:
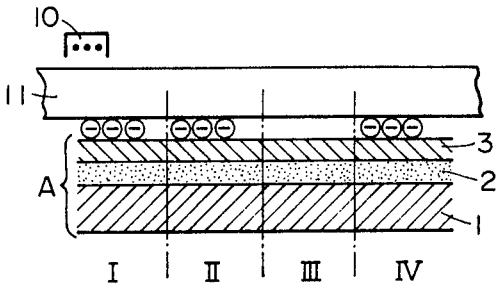
FIG. 8 illustrates the process of transferring the developed image.
Figure 9A:
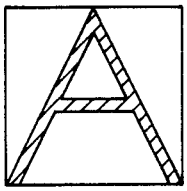
FIGS. 9 through 12 show various patterns of the first and second image originals and the corresponding visualized composite images formed therefrom.
Figure 9B:
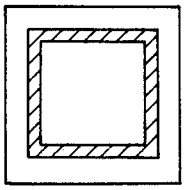
Figure 9C:
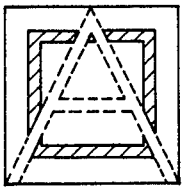
Figure 9D:
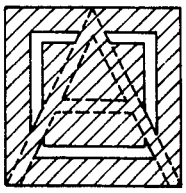
Figure 10A:
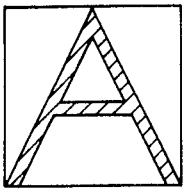
Figure 10B:
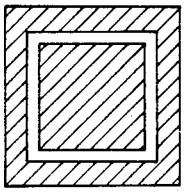
Figure 10C:
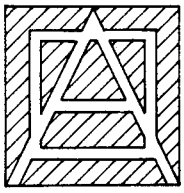
Figure 10D:
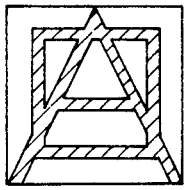
Figure 11A:
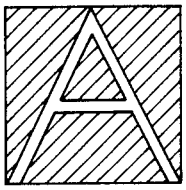
Figure 11B:
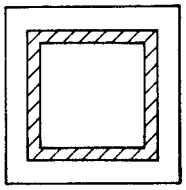
Figure 11C:
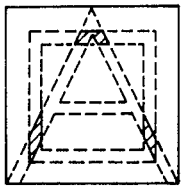
Figure 11D:
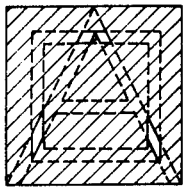
Figure 12A:
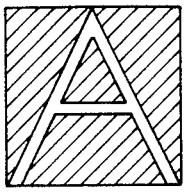
Figure 12B:
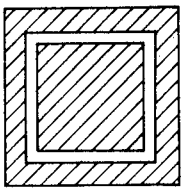
Figure 12C:
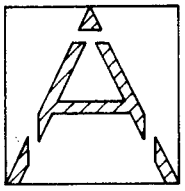
Figure 12D:
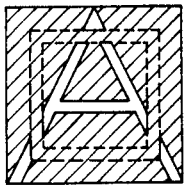

FIG. 7 illustrates reversal development, that is, development of the above latent image by using negative toner, the polarity of which is the same as that of the primary charging. Toner adheres to areas I, II and IV, which is contrary to the development shown in FIG. 6. In case of reversal development, as well-known in the art, a better development is assured by using a developing electrode.

FIGS. 9 through 12 show some examples of such composite image formation.

(a) is a first image original and (b) is a second image original. (c) is a composite image visualized by developing with positive toner and (d) is that by developing with negative toner. As will be understood from the examples, different composite visualized images can be obtained by using different light and dark patterns in the first and second images and different polarities. The composite image can be selected at will in accordance with the purpose for which the composite image is to be used.

The developed image on the insulating layer surface can be transferred onto a transfer member such as paper 11 by using a corona discharger 10 as shown in FIG. 10. This transferring step may be carried out by applying an external voltage such as bias voltage or making use of an internal field. After transferring, the image is fixed to form a final electrophotographic image. As fixing means there may be used infrared rays, heat and pressure.

On the other hand, after transferring, the insulating layer surface is cleaned in a manner known per se to remove the remaining charged particles from the surface of the photosensitive medium A which is used repeatedly for a large number of times.

Preferably this cleaning is carried out after discharging those charges used for forming the electrostatic image on the surface of the insulating layer 3. By doing so, the effect of cleaning can be increased. This may be accomplished by subjecting the surface to the action of AC corona discharge prior to cleaning. After discharging those charges used for forming the electrostatic image in this manner, cleaning is carried out using an elastic blade, for brush or other suitable means. A further improvement of cleaning effect can be attained by electrifying the cleaning means with opposite polarity to that of charged colored particles.

The cleaning effect also depends upon the property of material of the insulating layer, in particular, its adhesion property. All the resins previously mentioned are suitable materials for the insulating layer. Among them, fluorine resin is excellent in non-adhesiveness and therefore it is most preferable.

An electrostatic image desirable for development has the following characteristics:

(1) there is a sufficiently great difference in surface potential between $V_{LD}$ and $V_{DD}$, $V_{DL}$, $V_{LL}$; and (2) there is no difference in surface potential among the three of $V_{DD}$, $V_{DL}$ and $V_{LL}$.

To satisfy the above requirements it is required to carefully and suitably select and set the following factors:

(1) properties of photoconductive substances used in the layer 2;

(2) exposure values of the first and second images;

(3) polarity and intensity of the primary charge; and (4) intensity of AC corona discharge.

Now, an example of the electrophotographic method of the invention is described in detail and quantitatively.

To 100 g of cadmium sulfide activated with copper are added 10 g of vinyl chloride and a small amount of thinner and they are thoroughly mixed together to form a photosensitive coating mixture. The resultant coating mixture is coated on a polished aluminum cylinder up to 50$\mu$ in thickness. An insulating layer 35$\mu$ thick is overlaid on the photoconductive layer coated on the aluminum cylinder. Thus, a photosensitive medium is prepared.

A positive 6.5 KV corona discharge is applied to the insulating layer surface of the photosensitive medium while exposing the surface to a first image (illumination at light area: about 12 lux and exposure time: 0.3 sec.) nearly simultaneously with the corona discharge. Then, an AC 7.5 KV corona discharge is applied to the surface of the photosensitive medium while exposing the surface to a second image with the same exposure value as that of the first image and nearly simultaneously with the AC corona discharge.

Thereafter, the whole surface of the photosensitive medium is uniformly exposed to illumination of about 12 lux for about 0.8 seconds so as to form an electrostatic image of high contrast on the insulating surface. Surface potentials on the photosensitive medium are measured with a surface potential meter during the above electrostatic image forming process.

As a result of measurements in the above example, it was found that the surface potential of $V_P$ (see FIG. 5) was +1400 V and the surface potential difference between $V_{LD}$ and $V_{LL}$, $V_{DD}$, $V_{DL}$ was about 400 V.

Figure 13:
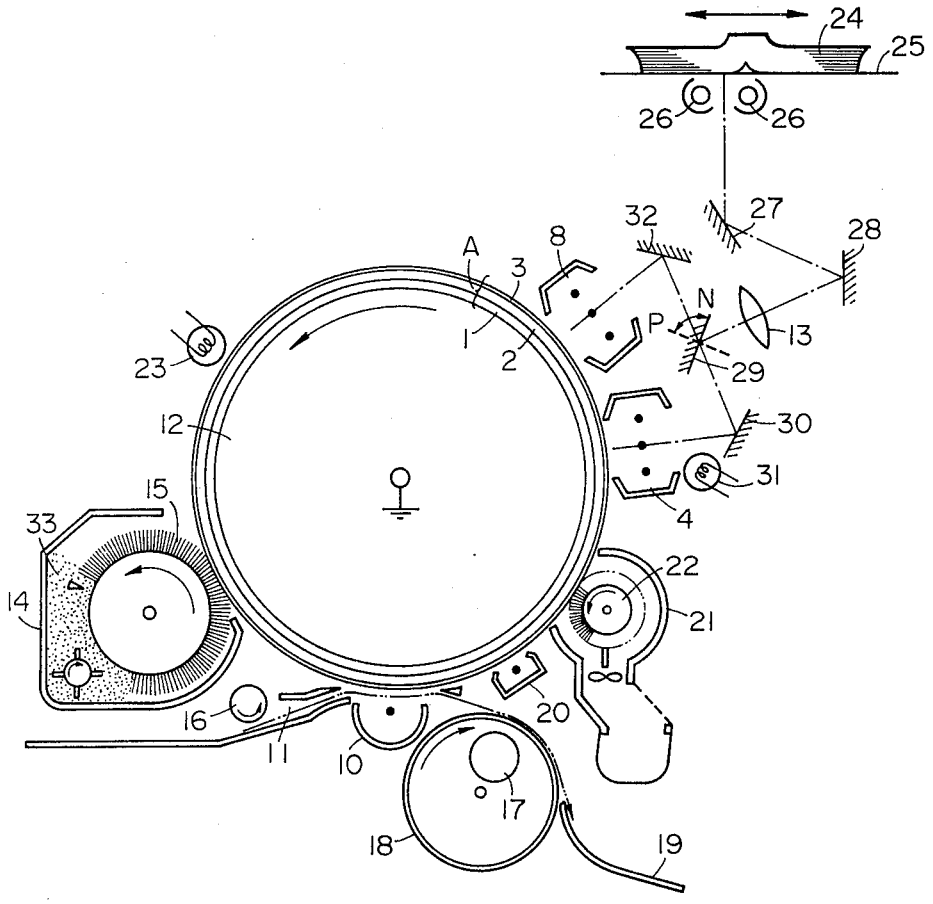
FIG. 13 is a schematic view of an electrophotographic copying apparatus in which the present invention is embodied.

FIG. 13 shows an example of a copying machine in which the present invention is embodied. With the copying machine copies can be produced in any desired mode of positive-positive and negative-positive in accordance with the teachings of the present invention. Of course, the polarities of chargers as well as toner used in the copying machine are fixed and therefore the polarity of each element remains unchanged even when the mode is changed over from positive-positive to negative-positive and vice versa.

In FIG. 13, a rotary drum 12 carries thereon the above described photosensitive medium A comprising an electrically conductive substrate layer 1, a photoconductive layer 2 and an insulating layer 3. The drum 12 is driven to rotate in the direction of arrow. A corona discharger for primary charging 4 is connected to a negative (−) polarity high voltage power source (not shown) and an AC corona discharger 8 is connected to an AC high voltage power source (not shown).

Designated by 33 is a known developing agent which may be a mixture of carrier (for example, iron powder) and charged and colored particles (toner) or a monocomponent developing agent without carrier. In this embodiment, the toner is charged with positive (+) charges.

In the case of, a copying operation adjusted the mode of positive-positive copies and original 24 is placed on an original table 25. In response to a copy instruction signal the original table 25 is moved in synchronism with the rotation of the photosensitive medium A in a manner known per se. An original illumination lamp 26 illuminates the original which reflects the illumination light. The reflected light enters a positive-negative change-over mirror 29 through mirrors 27, 28 and an imaging lens 13. The change-over mirror 29 has been preset to its P-position by means of a signal coming from a positive-negative change-over switch (not shown). In link with the setting motion of the change-over mirror 29 to the P- or N-position, a tungsten lamp 31 is put on (in case of P) or put off (in case of N).

The change-over mirror 29 reflects the light reflected by the original 24 toward a mirror 32 which directs the light to an AC corona discharger 8 to expose the photosensitive medium A to the original image light. Prior to this image-wise exposure, the photosensitive medium A has been negatively charged by the corona discharger for primary charging 4. This primary charging is carried out nearly simultaneously with the exposure on the photosensitive medium by the tungsten lamp 31 from the side of the surface of the insulating layer 3.

As described above, the light image of the original, that is, the reflected light from the original 24 is projected on the surface of photosensitive medium A through AC corona discharger 8. Almost at the same time, a corona discharge is applied to the surface by the AC corona discharger 8. After that, the whole surface of the insulating layer 3 is uniformly exposed to light by another tungsten lamp 23. Thus, an electrostatic image is formed on the surface of the insulating layer 3 corresponding to the light and dark pattern of the reflected light by the original 24. Passing through the developing station 14, the electrostatic image is developed with toner by a known developing device in a form of magnetic brush 15 or sleeve developer. Thus, a visualized image is obtained.

Figure 14A:
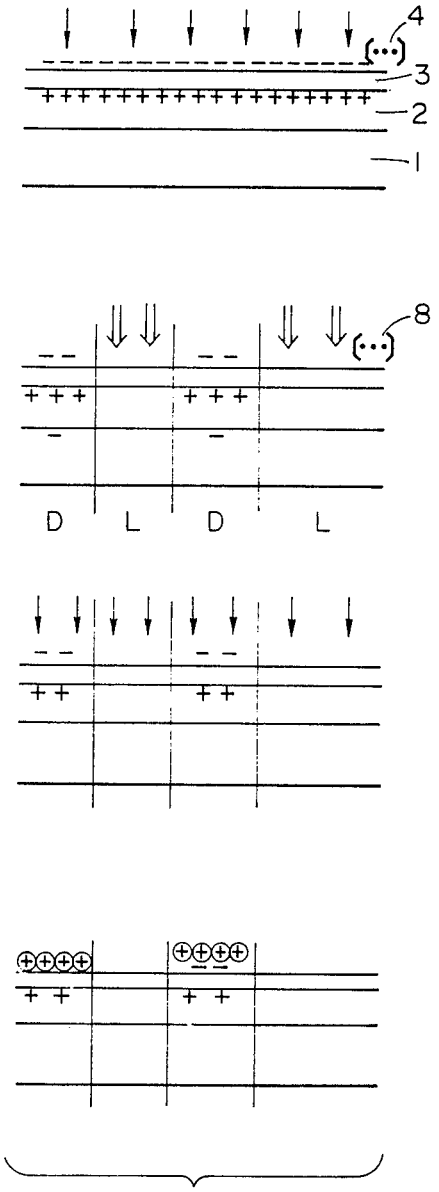
FIGS. 14A and 15A illustrate the processes of positive-positive and negative-positive image formations as normal images.
Figure 14B:
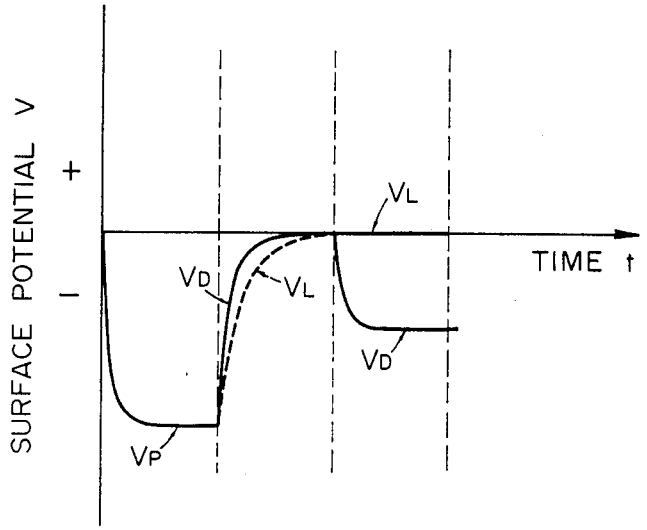
FIGS. 14B and 15B are graphs showing the changes of surface potentials in the processes shown in FIGS. 14A and 15A respectively.

FIG. 14A illustrates the charge patterns at different steps of the above copy making process in the positive-positive mode and FIG. 14B shows the changes of surface potentials at the corresponding different steps.

In FIG. 14, "D" means area of the latent image corresponding to dark portion of the original, namely, such original portion from which no reflected light comes to, and "L" means area of the latent image corresponding to light portion of the original. At the area D there is produced an electric field by its surface potential $V_D$ and therefore colored particles positively charged can adhere to the area D. On the contrary, at the area L, since the surface potential $V_L$ is about 0, no developer particle can adhere to the area L. In this manner, a visualized positive toner image can be produced from a positive original.

After developing, the visualized powder image is moved to the transferring station where the powder image comes into contact with a transfer sheet 11 fed by a roller 16 and the former is transferred onto the latter with the aid of corona discharge by a transferrence promoting corona discharger 10 whose polarity is opposite to that of the charged developer particle. After transferring the developed image on the transfer sheet 11 is fixed by a fixing device which, in the shown embodiment, comprises a heating drum 18 and an infrared lamp 17 contained in the drum. The completed electrophotographic copy is finally received by a tray 19.

On the other hand, after passing through the transferring station the photosensitive medium A enters the cleaning station. At the cleaning station, the photosensitive medium is at first subjected to the cleaning treatment by an AC corona discharger 20 to discharge the remaining charges used to form the electrostatic image on the insulating layer 3, and then it is subjected to the cleaning action of a cleaning device 21. The cleaning device comprises a rotary fur brush 22 to clean off the remaining powder image from the surface of the photosensitive medium. Thus, the photosensitive medium gets ready for the next cycle of the process.

Secondly, the manner of operation of the same copying machine in the negative-positive mode will be described hereinafter. In this mode, the copying machine produces positive copies from negative originals.

The operation of the copying apparatus in this mode is substantially the same as that for the positive-positive mode described above excepting the following points:

A negative-positive mode selection signal is issued from the change-over switch (not shown). In response to the signal, (1) the positive-negative change-over mirror 29 is set to its N-position (FIG. 13) so as to introduce the reflected light by the original 25 not into AC corona discharger 8 but to the primary charging corona discharger 4 through a mirror 30 (in this mode AC corona discharge is carried out in the dark), and (2) the tungsten lamp 31 is put off.

Thereafter, the copying operation proceeds in the same manner as the above.

Figure 15A:
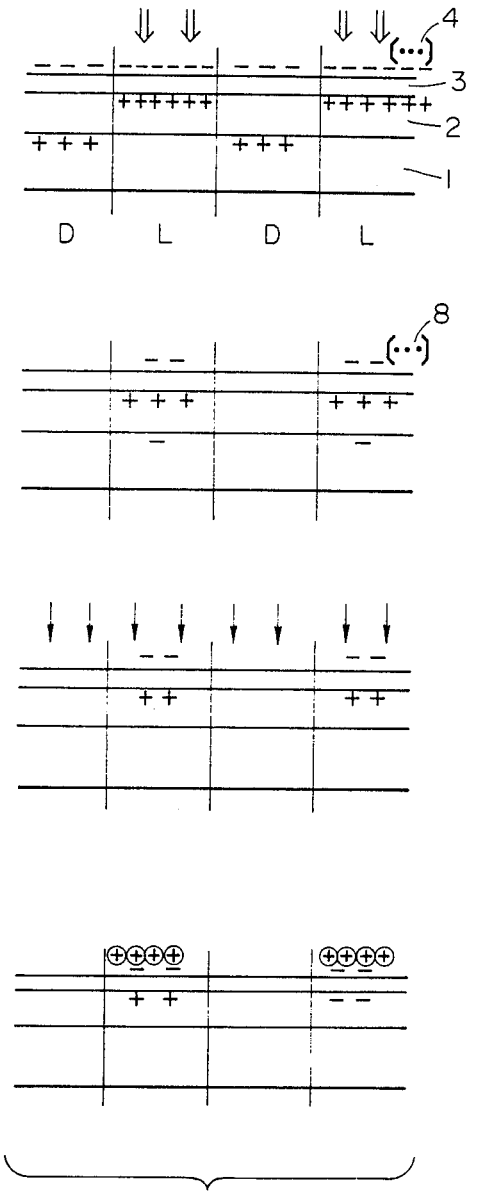
Figure 15B:
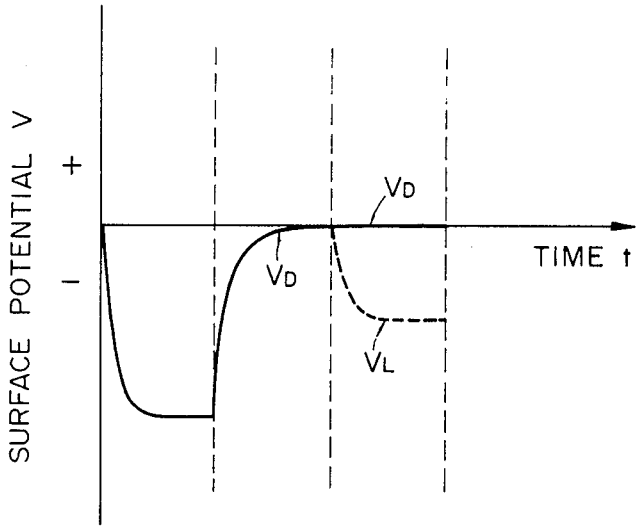

FIGS. 15A and 15B illustrate the process of an image formation in the negative-positive mode.

At the area L (which has the same meaning as above), there is produced an electric field by surface potential $V_L$ and therefore colored developing particles positively charged can adhere to the area L. However, at the area D (which has the same meaning as above), since its surface potential $V_D$ is about 0, the developing particles can not adhere to the area D. Thus, finally a visualized positive powder image is produced from a negative original.

While in the above embodiment there has been used a toner positively charged, toner negatively charged also may be used in the same apparatus to carry out a so-called reversal development. In this case, the negatively charged toner adheres in areas where, in FIGS. 14A and 15A, the positively charged toner can not adhere. Also, in this case, the mode can be selectively changed over from one to another in one and same apparatus in a manner similar to that described with the exception that the positive-positive mode in the above embodiment is replaced by the negative-positive mode for this case and the negative-positive mode by positive-positive mode.

Also, while in the above embodiment the present invention has been particularly described in connection with a copying machine, the present invention is applicable to other image forming apparatus. For example, a microfilm enlargement apparatus capable of changing over the mode from positive-positive to negative-positive and vice versa can be provided by substituting an illumination system for microfilm as an original for the part including the original table 25, original 24 and the illumination system 26 in the copying machine shown in FIG. 19.

Similarly, the present invention is applicable to a laser beam printer of the type in which laser beam is used in place of the above described image exposure light and spot exposure is carried out on the photosensitive medium while intensity-modulating the laser beam according to the information of image.

EMBODIMENT 2

Figure 16:
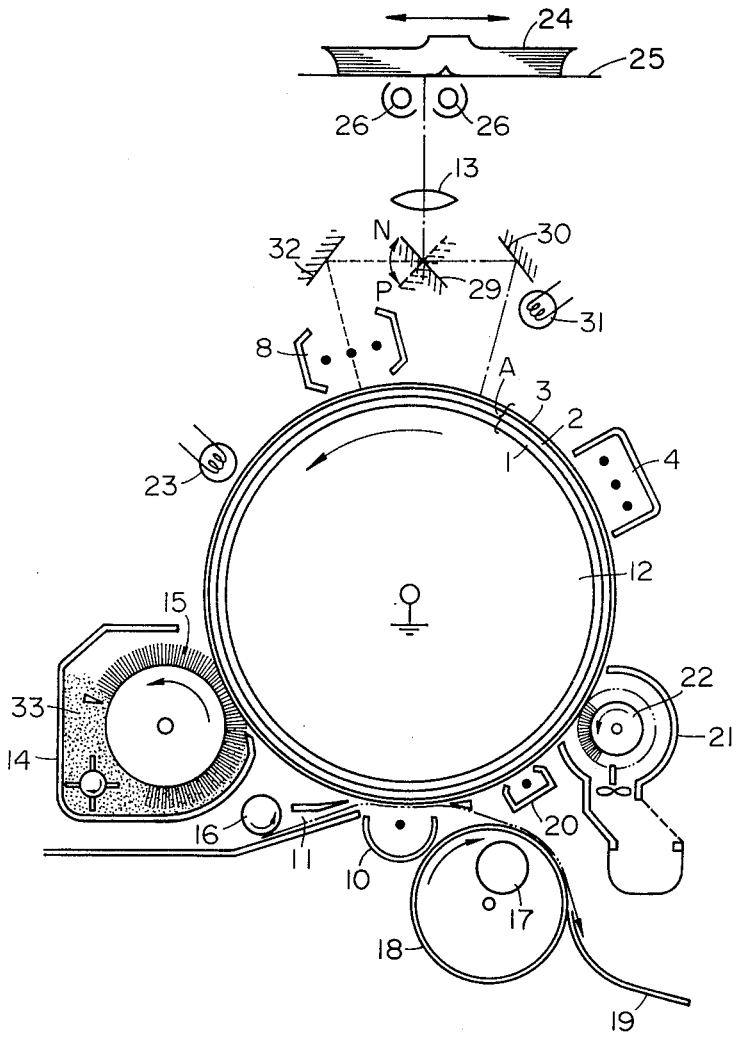
FIG. 16 is a schematic view of an electrophotographic copying machine showing another embodiment of the invention.
Figure 17A:
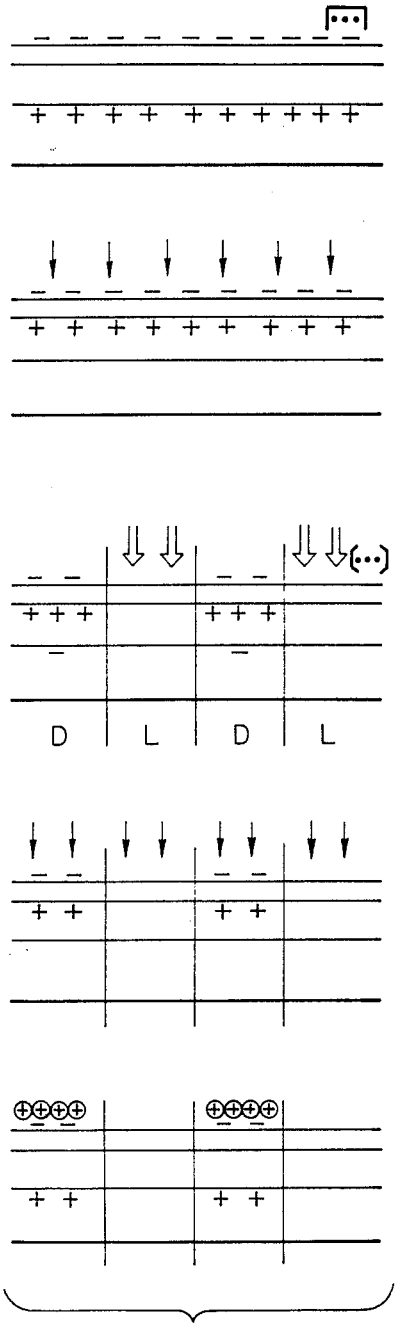
FIGS. 17A and 18A illustrate the processes of positive-positive and negative-positive image formations as normal images with the apparatus shown in FIG. 16.
Figure 18A:
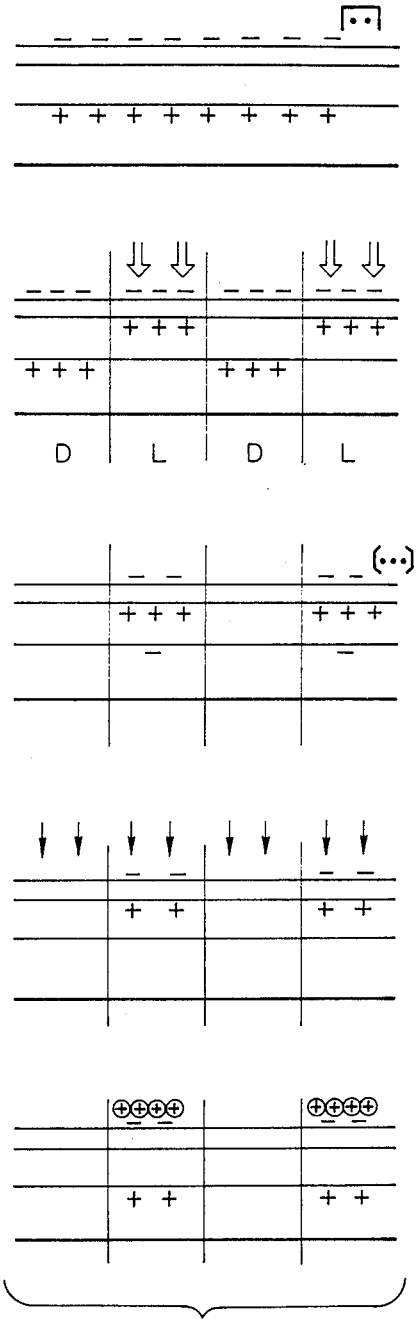
Figure 17B:
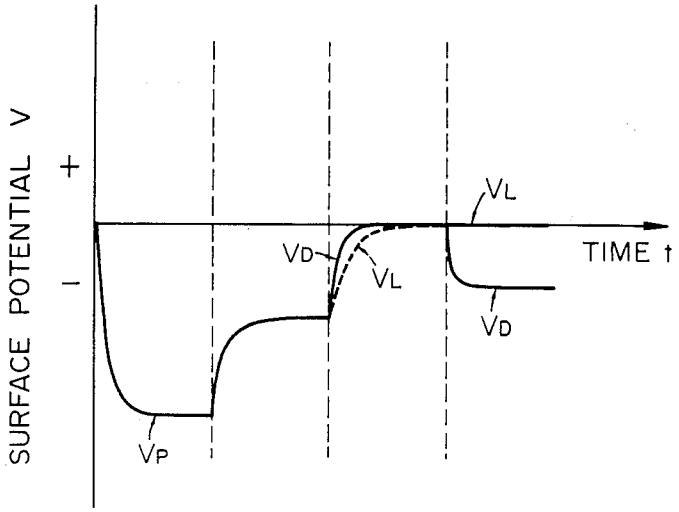
FIGS. 17B and 18B are graphs showing the changes of surface potentials in the processes shown in FIGS. 17A and 18A respectively.
Figure 18B:
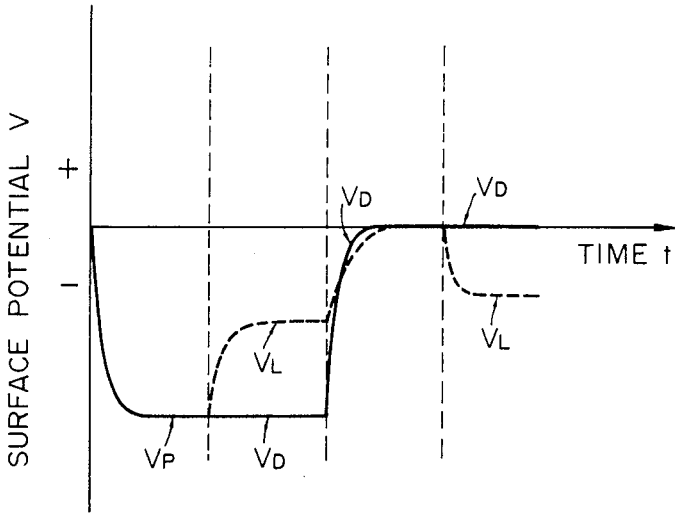

FIGS. 16 to 18 show a second embodiment of the invention. In the drawings FIG. 16 corresponds to FIG. 13 of the first embodiment, FIGS. 17A and 17B to FIGS. 14A and 14B and FIGS. 18A and 18B to FIGS. 15A and 15B.

This second embodiment employs an electrophotographic system of the type in which a photosensitive medium composed of essentially an electrically conductive substrate, a photoconductive layer and an insulating layer is used, and which comprises the steps of uniformly charging the surface of the top insulating layer, exposing the photosensitive medium to light to form a first image, exposing the photosensitive medium to light to form a second image with nearly simultaneous AC discharge, and uniformly illuminating the whole surface of the photosensitive medium so as to form a composite latent image resultant from the first and second images.

According to the invention, the first and second images to be formed are identical with each other and either image is selectively exposed while changing over the light path from one to another in the apparatus. When the image-wise exposure is carried out at only the first image exposure part, the photosensitive medium, after the image-wise exposure, is subjected to AC discharge while keeping it in the dark and then the whole surface of the photosensitive medium is exposed to light so that electric charges can remain only on such surface area of the photosensitive medium corresponding to the light part of the image so as to form an electrostatic latent image.

When the image-wise exposure is carried out at the second image exposure part, the process proceeds as follows:

At first, the surface of the insulating layer is uniformly charged and then a whole surface exposure is carried out on the photosensitive medium. Thereafter, the photosensitive medium is exposed to the light image at the second image exposure part with nearly simultaneous AC discharge and then the whole surface of the photosensitive medium is uniformly illuminated so that electric charges can remain only on such surface area of the photosensitive medium corresponding to the dark part of the image so as to form an electrostatic latent image.

Therefore, the copying mode can be changed over at will from positive-positive to negative-positive and vice versa only by changing over the light path for image formation light from one to another. There is no need of changing the polarity for charging the photosensitive medium and the polarity of developing toner.

FIG. 16 illustrates an example of a copying machine which can make either copy of positive-positive and negative-positive at will in accordance with the process of the present invention. Of course, the polarities of chargers as well as toner used in the copying machine are fixed and therefore the polarity of each element remains unchanged even when the mode is changed over from positive-positive to negative-positive and vice versa.

In FIG. 16, a rotary drum 12 carries thereon the above described photosensitive medium A comprising an electrically conductive substrate layer 1, a photoconductive layer 2 and an insulating layer 3. The drum 12 is driven to rotate in the direction of the arrow. A corona discharger for primary charging 4 is connected to a negative (−) polarity high voltage power source (not shown) and an AC corona discharge 8 is connected to an AC high voltage power source (not shown).

Designated by 33 is a known developing agent which may be a mixture of carrier (for example, iron powder) and charged and colored particles (toner) or a monocomponent developing agent without carrier. In this embodiment, the toner is charged with positive (+) charges.

In the case of, a copying operation according to a selected mode of positive-positive copying, an original 24 is placed on an original table 25. In response to a copy instruction signal the original table 25 is moved in synchronism with the rotation of photosensitive medium A in a manner known per se. An original illumination lamp 26 illuminates the original which reflects the illumination light. The reflected light enters a positive-negative change-over mirror 29′ through an imaging lens 13. The change-over mirror 29′ has been preset to its P-position by means of a signal coming from a positive-negative change-over switch (not shown). In link with the setting motion of the change-over mirror 29′ to P- or N-position, a tungsten lamp 31 is put on (in case of P) or put off (in case of N).

The change-over mirror 29′ reflects the light reflected by the original 24 toward a mirror 32′ which directs the light to the AC corona discharger 8 to expose the photosensitive medium A to the original image light. Prior to this image-wise exposure, the photosensitive medium A has been negatively charged by the corona discharger for primary charging 4. This primary charging is followed by an exposure on the photosensitive medium by the tungsten lamp 31 from the side of the surface of insulating layer 3.

As described above, the light image of an original, that is, the reflected light by the original 24, is projected on the surface of photosensitive medium A through AC corona discharger 8. Almost at the same time, corona discharge is applied to the surface by the AC corona discharger 8. After that, the whole surface of the insulating layer 3 is uniformly exposed to light by another tungsten lamp 23. Thus, an electrostatic image is formed on the surface of the insulating layer 3 corresponding to the light and dark pattern of the reflected light by the original 24. Passing through the developing station 14, the electrostatic image is developed with toner by a known developing device in a form of magnetic brush 15. Thus, a visualized image is obtained.

FIG. 17A illustrates the charge patterns at different steps of the above copy making process in the positive-positive mode and FIG. 17B shows the change of surface potentials at the corresponding different steps.

Again, in FIG. 17, "D" means the area of the latent image corresponding to dark portion of the original, namely, such original portion from which no light is reflected, and "L" means area of the latent image corresponding to light portion of the original. At the area D there is produced an electric field by its surface potential $V_D$ and therefore colored particles positively charged can adhere to the area D. On the contrary, at the area L, since the surface potential $V_L$ is about 0, no developer particle can adhere to the area L. In this manner, a visualized positive toner image can be produced from a positive original.

After developing, the visualized powder image is moved to the transferring station where the powder image comes into contact with a transfer sheet 11 fed by a roller 16 and the former is transferred onto the latter with the aid of corona discharge by a transference promoting corona discharger 10 whose polarity is opposite to that of the charged developer particle. After transferring the developed image on the transfer sheet 11 is fixed by a fixing device which, in the shown embodiment, comprises a heating drum 18 and an infrared lamp 17 contained in the drum. The completed electrophotographic copy is finally received by a tray 19.

On the other hand, after passing through the transferring station the photosensitive medium A enters the cleaning station. At the cleaning station, the photosensitive medium is at first subjected to the cleaning treatment by an AC corona discharger 20 to discharge the remaining charges used to form the electrostatic image on the insulating layer 3, and then it is subjected to the cleaning action of a cleaning device 21. The cleaning device comprises a rotary fur brush 22 to clean off the remaining powder image from the surface of the photosensitive medium. Thus, the photosensitive medium gets ready for the next cycle of process.

Secondly, the manner of operation of the same copying machine in the negative-positive mode will be described hereinafter. In this mode, the copying machine produces positive copies from negative originals.

The operation of the copying apparatus in this mode is substantially the same as that for positive-positive mode described above excepting the following points:

A negative-positive mode selection signal is issued from the change-over switch (not shown). In response to the signal, (1) the positive-negative change-over mirror 29' is set to its N-position so as to introduce the reflected light by the original 25 not into AC corona discharger 8 but to the surface of insulating layer 3 between the primary charging corona discharger 4 and AC discharger 8 through a mirror 30 (in this mode AC corona discharge is carried out in the dark), and (2) the tungsten lamp 31 is put off.

Thereafter, the copying operation proceeds in the same manner as above.

FIGS. 18A and 18B illustrate the process of an image formation in the negative-positive mode.

At the area L (which has the same meaning as above), there is produced an electric field by surface potential $V_L$ and therefore colored developing particles positively charged can adhere to the area L. However, at the area D (which has the same meaning as above), since its surface potential $V_D$ is about 0, the developing particles can not adhere to the area D. Thus, finally a visualized positive powder image is produced from a negative original.

While in the above embodiment there has been used a toner positively charged, toner negatively charged also may be used in the same apparatus to carry out a so-called reversal development. In this case, the negatively charged toner adheres in areas where, in FIGS. 17A and 18A, the positively charged toner can not adhere. Also, in this case, the mode can be selectively changed over from one to another to one and same apparatus in a manner similar to the above with the exception that the positive-positive mode in the above embodiment is replaced by negative-positive mode for this case and the negative-positive mode by the positive-positive mode.

EMBODIMENT 3

Figure 19A:
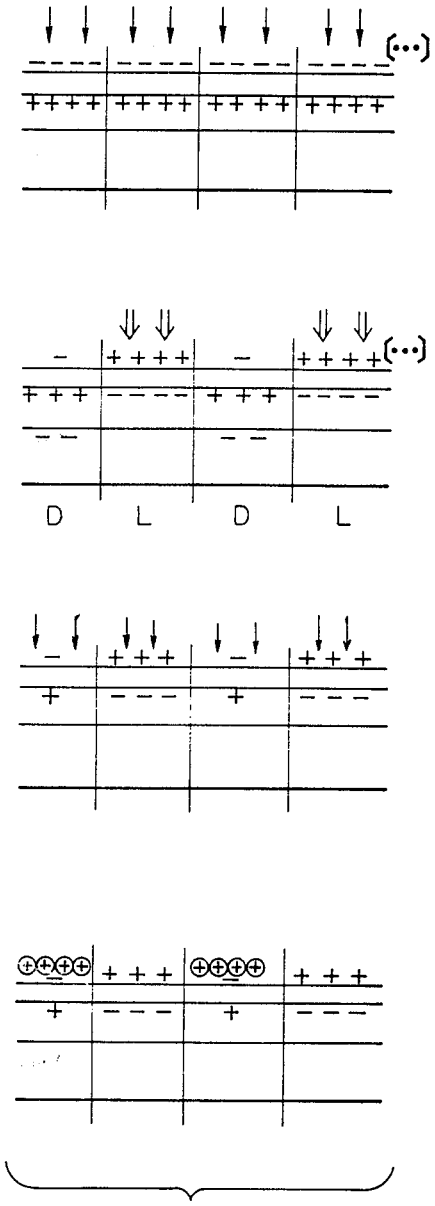
FIGS. 19A and 20A illustrate the processes of positive-positive and negative-positive image formations using apparatus according to a further embodiment of the invention.
Figure 20A:
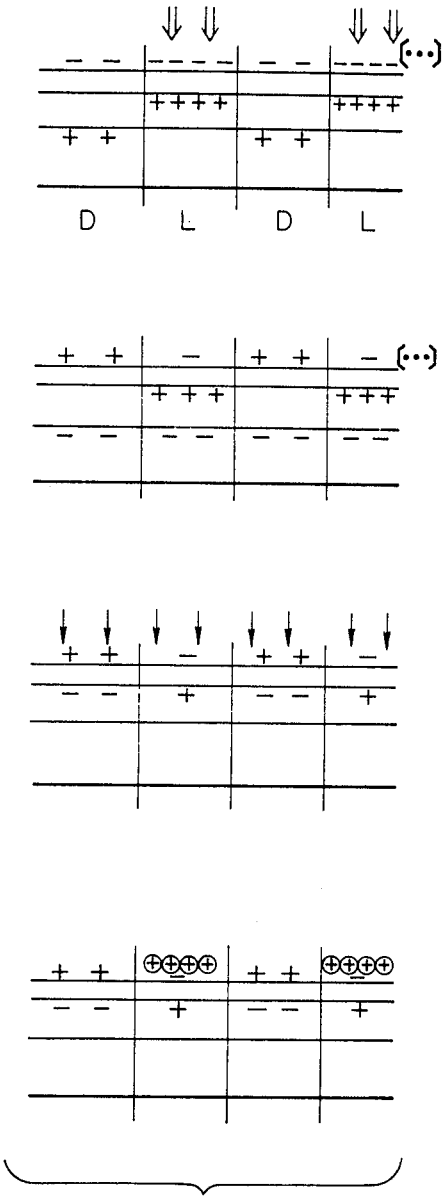
Figure 19B:
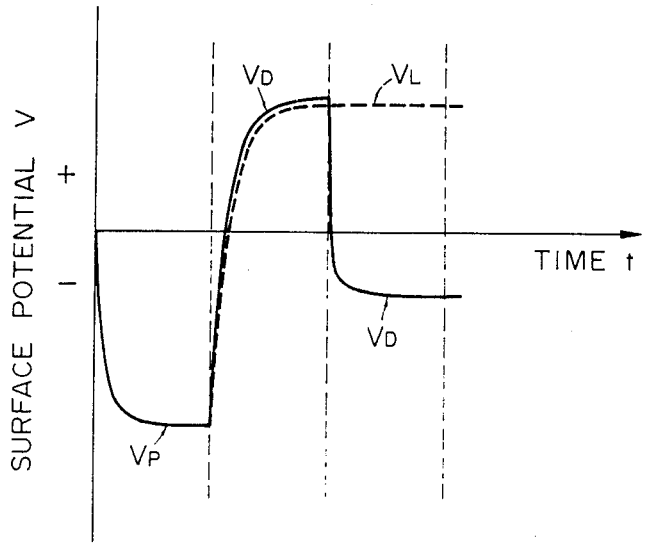
FIGS. 19B and 20B are graphs showing the changes of surface potentials in the above processes.
Figure 20B:
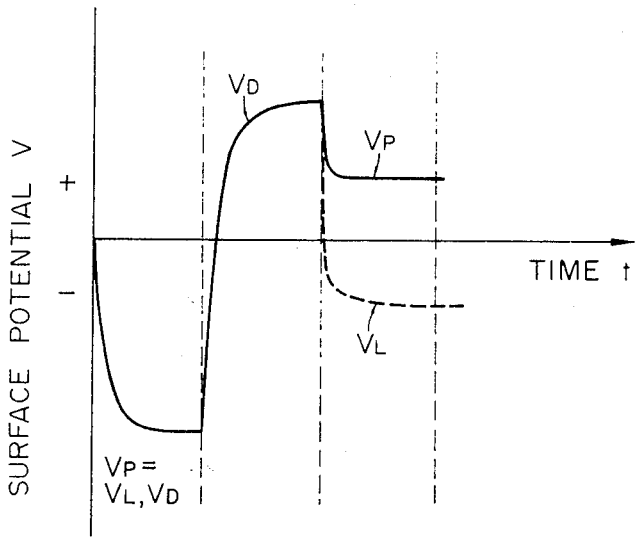

A third embodiment of the invention is shown in FIGS. 19 and 20 of which FIGS. 19A and 19B correspond to FIGS. 14A and 14B of the first embodiment and FIGS. 20A and 20B to FIGS. 15A and 15B respectively.

The third embodiment is based on an electrophotographic system of the type in which a photosensitive medium essentially comprising an electrically conductive substrate, a photoconductive layer and an insulating layer is used, and which comprises the steps of applying electric charges onto the insulating layer surface while exposing the surface to form a first image nearly simultaneously with the primary charging electric charges are then applied with an opposite polarity to that of the primary charge while exposing the surface to form a second image nearly simultaneously with the secondary charging and then the whole surface of the photosensitive medium is illuminated uniformly so as to form an electrostatic latent image corresponding to a composite image resultant from the first and second images.

In the above system, according to the features of the present invention, the first and second images to be formed are identical with each other and either image is selectively exposed while changing over the light path from one to another. When the image-wise exposure is to be carried out only at the first image exposure part, the surface of the photosensitive medium is exposed to light to form a first image nearly simultaneously with application of the primary charge to the insulating layer surface, then the surface is charged, in the dark, with the opposite polarity to that of the primary charge and the whole surface of the photosensitive medium is uniformly exposed to light. When the image-wise exposure is to be carried out only at the second image exposure part, the whole surface of the photosensitive medium is uniformly illuminated nearly simultaneously with application of the primary charge to the insulating layer surface, then the surface of the photosensitive medium is exposed to the light introduced into the second image exposure part while applying to the insulating layer surface the secondary charge with the opposite polarity to that of the primary charge and the whole surface of the photosensitive medium is uniformly exposed to light.

Therefore, the copy making mode can be changed over at will from positive-positive to negative-positive and vice versa simply by changing over the light path for image formation from one to another. There is no need of changing the polarity for charging the photosensitive medium and the polarity of developer toner.

Apparatus useful for carrying out the embodiment can be provided by slightly modifying the apparatus shown in FIG. 13. This can be attained by replacing only the AC corona discharger 8 by a DC corona discharger whose polarity is opposite to that of the primary charge. With the apparatus modified in this manner, change-over of the copy mode can be accomplished by suitably selecting the position of positive-negative change-over mirror 29.

In the apparatus shown in FIG. 13, the positive-negative change-over mirror 29 is preset to its P-position by means of a signal coming from the positive-negative change-over switch. In link with the setting motion of the change-over mirror 29 to P- or N-position, a tungsten lamp 31 is put on (in case of P) or put off (in case of N).

The change-over mirror 29 reflects the light reflected by the original 24 toward a mirror 32 which directs the light to recharging corona discharger 8 to expose the photosensitive medium A to the original light. Prior to this image-wise exposure, the photosensitive medium A has been negatively charged by the corona discharger for primary charging 4. This primary charging is carried out nearly simultaneously with the exposure on the photosensitive medium by the tungsten lamp 31 from the side of the surface of insulating layer 3.

As described above, the light image of the original, that is, the reflected light from the original 24 is projected on the surface of photosensitive medium A through the recharging corona discharger 8. Almost at the same time, corona discharge of positive polarity is applied to the surface by the recharging corona discharger 8. After that, the whole surface of the insulating layer 3 is uniformly exposed to light by another tungsten lamp 23. Thus, an electrostatic image is formed on the surface of the insulating layer 3 corresponding to the light and dark pattern of the reflected light by the original 24. Passing through the developing station 14, the electrostatic image is developed with toner by a known developing device in a form of magnetic brush 15. Thus, a visualized image is obtained.

FIG. 19A illustrates the charge patterns at different steps of the above copy making process in the positive-positive mode and FIG. 19B shows the change of surface potentials at the corresponding different steps.

In FIG. 19, "D" means area of the latent image corresponding to dark portion of the original, namely, such original portion from which no light is reflected, and "L" means area of the latent image corresponding to the light portion of the original. At the area D there is produced an electric field by its surface potential $V_D$ and therefore colored particles positively charged can adhere to the area D. On the contrary, at the area L, since the surface potential $V_L$ is about 0 no developer particle can adhere to the area L. In this manner, a visualized positive toner image can be produced from a positive original.

The operation of the copying apparatus in the negative-positive mode is substantially the same as that for the positive-positive mode described above excepting the following points:

A negative-positive mode selection signal is issued from the change-over switch. In response to the signal, (1) the positive-negative change-over mirror 29 is set to its N-position so as to introduce the reflected light by the original 25 not into the opposite polarity charging corona discharger 8 but to the primary charging corona discharger 4 through a mirror 30 (in this mode, corona discharge of opposite polarity is carried out in the dark), and (2) the tungsten lamp 31 is put off.

Thereafter, the copying operation proceeds in the same manner as the above.

FIGS. 20A and 20B illustrate the process of image formation in the negative-positive mode.

At the area L (which has the same meaning as above), there is produced an electric field by surface potential $V_L$ and therefore colored developing particles positively charged can adhere to the area L. However, at the area D (which has the same meaning as above), since its surface potential $V_D$ is about 0, the developing particles can not adhere to the area D. Thus, finally a visualized positive powder image is produced from a negative original.

EMBODIMENT 4

Figure 21A:
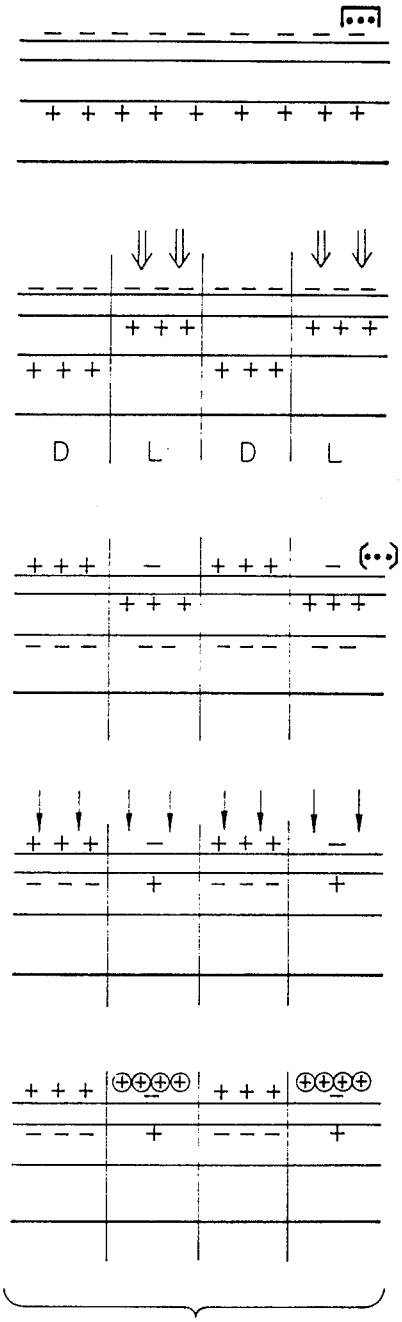
FIGS. 21A and 22A illustrate the processes of positive-positive and negative-positive image formations according to still a further embodiment of the invention.
Figure 22A:
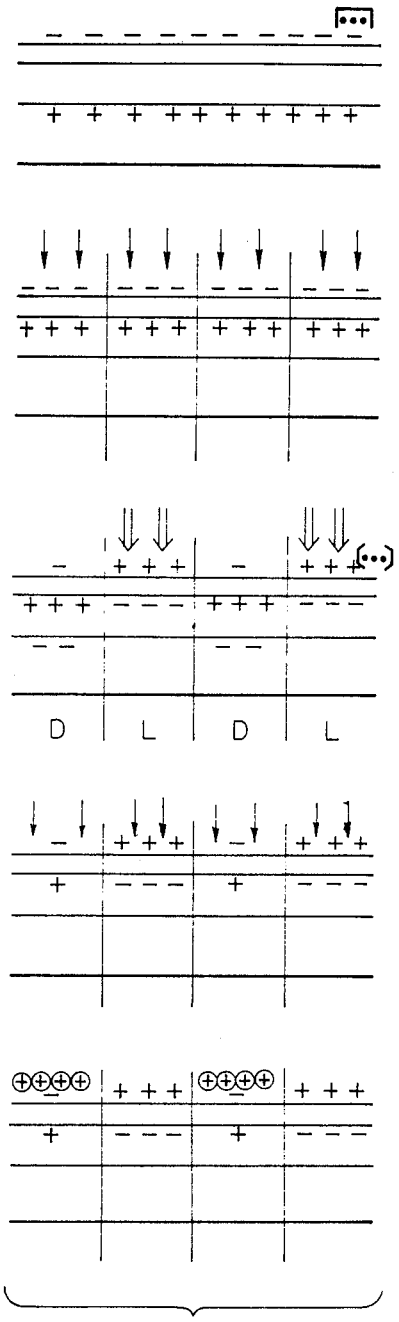
Figure 21B:
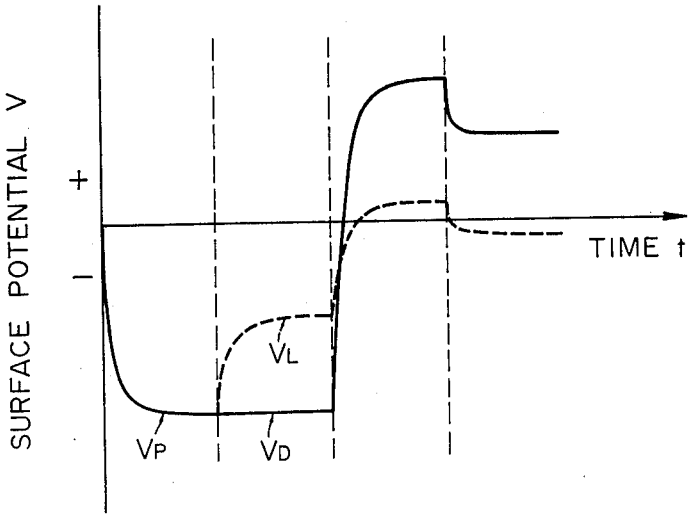
FIGS. 21B and 22B are graphs showing the changes of potentials in the above processes.
Figure 22B:
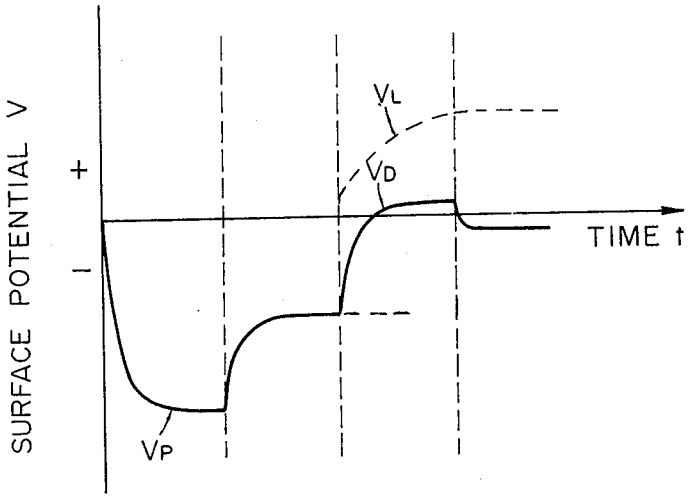

FIGS. 21 to 22 show a fourth embodiment of the invention. Of the drawings FIGS. 22A and 22B correspond to FIGS. 17A and 17B of the second embodiment, and FIGS. 21A and 21B to FIGS. 18A and 18B respectively.

This fourth embodiment employs an electrophotographic system of the type in which a photosensitive medium composed of essentially an electrically conductive substrate, a photoconductive layer and an insulating layer is used, and which comprises the steps of uniformly charging the surface of the top insulating layer, exposing the photosensitive medium to light to form a first image, exposing the photosensitive medium to light to form a second image with nearly simultaneous charging with the opposite polarity to that of the primary charge and uniformly illuminating the whole surface of the photosensitive medium so as to form a composite latent image resultant from the first and second images.

According to the invention, the first and second images to be formed are identical with each other and either image is selectively exposed while changing over the light path from one to another in the apparatus. When the image-wise exposure is carried out at only the first image exposure part, the photosensitive medium, after the image-wise exposure, is subjected to charging with the opposite polarity while keeping it in the dark and then the whole surface of the photosensitive medium is exposed to light.

When the image-wise exposure is carried out at the second image exposure part, the process proceeds as follows:

At first, the surface of the insulating layer is uniformly charged and then a whole surface exposure is carried out on the photosensitive medium. Thereafter, the photosensitive medium is exposed to the light image at the second image exposure part while nearly simultaneously charging the surface with electric charges of the opposite polarity and then the whole surface of the photosensitive medium is uniformly illuminated.

Therefore, the copy making mode can be changed over at will from positive-positive to negative-positive and vice versa simply by changing over the light path for image formation from one to another. One and the same apparatus can be used for different purposes.

Apparatus useful for carrying out the embodiment can be provided by slightly modifying the apparatus shown in FIG. 16. This can be attained only by replacing the AC corona discharger 8 by a DC corona discharger whose polarity is opposite to that of the primary charge. With the apparatus modified in this manner, change-over of the copy mode can be accomplished by suitably selecting the position of the positive-negative change-over mirror 29 in a manner similar to that of Embodiment 2.

In the apparatus shown in FIG. 16, the positive-negative change-over mirror 29 is preset to its P-position by means of a signal coming from a positive-negative change-over switch (not shown). In link with the setting motion of the change-over mirror 29 to P- or N-position, a tungsten lamp 31 is put on (in case of P) or put off (in case of N).

The change-over mirror 29 reflects the light reflected by the original 24 toward a mirror 32 which directs the light to the corona discharger 8 to expose the photosensitive medium A to the original image light. Prior to this image-wise exposure, the photosensitive medium A has been negatively charged by the corona discharger for primary charging 4. This primary charging is followed by a whole surface exposure on the photosensitive medium by the tungsten lamp 31 from the side of the surface of insulating layer 3.

As described above, the light image of the original, that is, the reflected light from the original 24 is projected on the surface of photosensitve medium A through the recharging corona discharger 8. Almost at the same time, corona discharge of positive polarity is applied to the surface by the corona discharger 8. After that, the whole surface of the insulating layer 3 is uniformly exposed to light by another tungsten lamp 23. Thus, and electrostatic image is formed on the surface of the insulating layer 3 corresponding to the light and dark pattern of the reflected light by the original 24. Passing through the developing station 14, the electrostatic image is developed with toner by a known developing device in a form of magnetic brush 15. Thus, a visualized image is obtained.

FIG. 22A illustrates the charge patterns at different steps of the above copy making process in the positive-positive mode and FIG. 22B shows the change of surface potentials at the corresponding different steps.

In FIG. 22, again "D" means area of the latent image corresponding to dark portion of the original, namely, such original portion from which no light is reflected, and "L" means area of the latent image corresponding to light portion of the original. At the area D there is produced an electric field by its surface potential $V_D$ and therefore colored particles positively charged can adhere to the area D. On the contrary, at the area L, since the surface potential $V_L$ is about 0, no developer particle can adhere to the area L. In this manner, a visualized positive toner image can be produced from a positive original.

The operation of the copying apparatus in the negative-positive mode is substantially the same as that for positive-positive mode described above excepting the following points:

A negative-positive mode selection signal is issued from the change-over switch. In response to the signal, (1) the positive-negative change-over mirror 29 is set to its N-position so as to introduce the reflected light by the original 25 not into the corona discharger 8 but to the insulating layer 3 between the primary charging corona discharger 4 and the recharging corona discharger 8 through a mirror 30 (in this mode, corona discharge of the opposite polarity is carried out in the dark), and (2) the tungsten lamp 31 is put off.

Thereafter, the copying operation proceeds in the same manner as described above.

FIGS. 21A and 21B illustrate the process of image formation in the negative-positve mode.

At the area L (which has the same meaning as above), there is produced and electric field by surface potential $V_L$ and therefore colored developing particles positively charged can adhere to the area L. However, at the area D (which has the same meaning as above), since its surface potential $V_D$ is about 0, the developing particles can not adhere to the area D. Thus, finally a visualized positive powder image is produced from a negative original.

While in the above each embodiment there has been used a toner positively charged, toner negatively charged also may be used in the same apparatus to carry out a so-called reversal development. In this case, the negatively charged toner adheres such area where the positively charged toner can not adhere. Also, in this case, the mode can selectively changed over from one to another in one and same apparatus in a manner similar to the above with the exception that the positive-positive mode in the above embodiment is replaced by negative-positive mode for this case and the negative-positive mode by positive-positive mode.

Also, while in each of the above embodiments the present invention has been particularly described in connection with a copying machine, the present invention is applicable to other image forming apparatus. For example, a microfilm enlargement apparatus capable of changing over the mode from positive-positive to negative-positive and vice versa can be provided by substituting an illumination system suitable for microfilm for the part including the original table, original, and illumination system in the copying machine.

Similarly, the present invention is applicable to a laser beam printer of the type in which laser beam is used in place of the above described image exposure light and spot exposure is carried out on the photosensitive medium while intensity-modulating the laser beam according to the information of image.

What we claim is:

1. An electrophotographic apparatus capable of selectively operating in a first or second operation mode to provide a high-low order between the potentials of the light area and dark area of a latent image formed in the first operation mode, which order is a reversal of the corresponding order between the potentials of the light area and dark area of a latent image formed in the second operation mode, said apparatus comprising:

(a) a photosensitive member having a photoconductive layer and an insulating layer formed on the photoconductive layer and moving through a first, a second and a third position in this order, said photoconductive layer having a property of substantially rejecting, in the dark area, the injection thereinto of charges of the polarity opposite to a first corona discharge;

(b) first corona discharger for applying said first corona discharge on the photosensitive member at said first position, the polarity of the first corona discharge being the same in the first and second operation modes;

(c) a second corona discharger for applying a second corona discharge on the photosensitive member at said second position, the second corona discharge having a component of the polarity opposite to the first corona discharge;

(d) a first illumination means for uniformly illuminating the photosensitive member at said third position;

(e) a second illumination means operating in the first operation mode but not operating in the second operation mode, the second illumination means, when operated, uniformly illuminating the photosensitive member at the first position or between the first and second positions; and (f) image light exposure means, the position of the image light exposure to the photosensitive member being capable of switching over between the first and second operation modes, the image light exposure means exposing the image light to the photosensitive member in the first operation mode at said second position and in the second operation mode at said first position or between said first and second positions.

2. An apparatus according to claim 1, wherein said second corona discharge is an AC corona discharge.

3. An apparatus according to claim 1, wherein said second corona discharge is a DC corona discharge having a polarity opposite to the first corona discharge.

4. An apparatus according to either one of claims 1 to 3, wherein said apparatus further comprises developing means supplying a developer to the latent image, the charged polarity of the developer being the same both in the first and second operation modes.

5. An apparatus according to claim 4, wherein the charged polarity of the developer is opposite to the polarity of the first corona discharge.

6. An apparatus according to claim 4, wherein the charged polarity of the developer is the same as the polarity of the first corona discharge.

* * * * *

UNITED STATES PATENT AND TRADEMARK OFFICE

CERTIFICATE OF CORRECTION

PATENT NO. : 4,486,088

DATED : December 4, 1984

INVENTOR(S) : TAKASHI KITAMURA, ET AL.

It is certified that error appears in the above-identified patent and that said Letters Patent is hereby corrected as shown below:

COVER PAGE

[57] IN THE ABSTRACT

Line 2, after "selection" insert --of--.

COLUMN 1

Line 41, after "such" insert --as--.

COLUMN 2

Line 26, after "invention" insert --,--.

Line 59, after "is" insert --then--.

Lines 62 and 63, image, and when" should read --image. When--.

COLUMN 5

Line 25, after "charge" insert --which--.

COLUMN 6

Line 42, after "such" insert --an--.

Line 43, "image" should read --images--.

COLUMN 8

Line 3, "FIG. 10" should read --FIG. 13--.

UNITED STATES PATENT AND TRADEMARK OFFICE

CERTIFICATE OF CORRECTION

PATENT NO. : 4,486,088

DATED : December 4, 1984

INVENTOR(S) : TAKASHI KITAMURA, ET AL.

It is certified that error appears in the above-identified patent and that said Letters Patent is hereby corrected as shown below:

COLUMN 8

Line 23, "for" should read --fur--.

COLUMN 9

Line 26, after "of" insert --the--.

Line 37, after "adjusted" insert --to--.

Line 38, after "copies" insert --,--;

"and" should read --an--.

COLUMN 10

Line 33, after "11" insert --, is--.

COLUMN 11

Line 35, "FIG. 19" should read --FIG. 13--.

COLUMN 13

Line 28, after "means" insert --the--.

Line 45, after "11" insert --, it--.

Line 67, after "for" insert --the--.

COLUMN 14

Line 50, change "charging electric" to read --charging. Electric--.

UNITED STATES PATENT AND TRADEMARK OFFICE

CERTIFICATE OF CORRECTION

PATENT NO. : 4,486,088

DATED : December 4, 1984

INVENTOR(S) : TAKASHI KITAMURA, ET AL.

It is certified that error appears in the above-identified patent and that said Letters Patent is hereby corrected as shown below:

COLUMN 17

Line 7, after "polarity" insert --,--.

Line 49, "and" should read --an--.

Lines 60 and 63, after "means" insert --the--.

COLUMN 18

Line 5, after "for" insert --the--.

Line 23, "and" should read --an--.

Line 31, "the above each embodiment" should read --each of the above embodiments--.

Line 35, "such area" should read --to such area--.

Line 37, after "can" insert --be--.

Signed and Sealed this

*Thirty-first* Day of *December 1985*

[SEAL]

*Attest:*

DONALD J. QUIGG

*Attesting Officer*

*Commissioner of Patents and Trademarks*